United States Patent [19]

Pavlak

[11] 4,212,636

[45] Jul. 15, 1980

[54] HEARTH STRUCTURE

[76] Inventor: Archibald W. Pavlak, 1476 Highview Ave., Eagan, Minn. 55121

[21] Appl. No.: 941,190

[22] Filed: Sep. 11, 1978

[51] Int. Cl.[2] ..... F27D 1/18

[52] U.S. Cl. ..... 432/250; 110/225; 110/336; 432/129

[58] Field of Search ..... 432/3, 151, 250, 129, 432/132; 110/225, 336

[56] References Cited

U.S. PATENT DOCUMENTS

| | | | |
|---|---|---|---|
| 800,588 | 9/1905 | Meyer | 432/132 |
| 946,178 | 1/1910 | Wedge | 432/132 |
| 2,221,076 | 11/1940 | Connolly | 432/250 |

*Primary Examiner*—John J. Camby
*Attorney, Agent, or Firm*—Wicks & Nemer

[57] ABSTRACT

Structure for an incinerator hearth is disclosed where the drop hole area of the hearth can be constructed entirely of standard shape, and thus readily available, fire brick rather than the special shapes previously necessary.

10 Claims, 2 Drawing Figures

HEARTH STRUCTURE

BACKGROUND

The present invention generally relates to incinerators, more specifically to hearth construction for incinerators, and more particularly to hearth construction for incinerators about the drop holes thereof.

Incinerating furnaces and the hearths therefore, such as those disclosed in U.S. Pat. No. 2,221,076 to Connolly and issued in 1940, have been standard in incinerating furnaces since the 1940s. These hearths required special shapes of fire brick and such special shapes are expensive, have poor availability and delivery, a lesser life, are relatively inflexible in design, and thus not adaptable to many specific situations.

SUMMARY

The present invention solves this and other problems in incinerating furnace hearths by providing, in the preferred embodiment, a less expensive hearth which may be constructed entirely of fire brick which is readily available. A hearth constructed according to the present invention would have a longer life and suffer less deterioration and would have brick which could be made by standard machinery, because the shapes are standardized. The fire block utilized can then be of a higher quality. The construction of the present invention also allows a flexibility in design and an adaptability in dimension not heretofore believed possible.

The present invention is then for hearth construction for utilization in a substantially round walled incinerator structure which includes at least one hearth, and generally many, having at least one drop hole, and generally many more, per hearth. The hearth includes a main body of fire brick extending from the outer wall of the hearth and towards the center of the incinerator and joining the fire brick forming the drop hole area of the hearth. The present invention then relates to the drop hole area and generally, in its preferred embodiment, includes skew-backs extending from the wall of the hearth, two side projections of standard size straight fire brick extending out from the skew-backs to allow the desired size of drop hole and form the sides of the drop hole, and an arch of standard size arch brick between the side projections to close the drop hole. The arch is then connected to the main body of fire brick forming the hearth by another particular feature of the present invention where the keystone of the arch projects outwardly beyond the dimension of the arch to thereby space the arch from the main body of fire brick, and the spacing is filled with a moldable refractory material.

It is thus an object of the present invention to provide a new hearth structure for incinerators.

It is further an object of the present invention to provide a new hearth structure for incinerators utilizing all standard shape fire brick to thereby gain the advantages set out above.

These and further objects and advantages of the present invention will become clearer in the light of the following detailed description of an illustrative embodiment of this invention described in connection with the drawings.

DESCRIPTION OF THE DRAWINGS

The illustrative embodiment may best be described by reference to the accompanying drawings where.

Figures 1, 2:
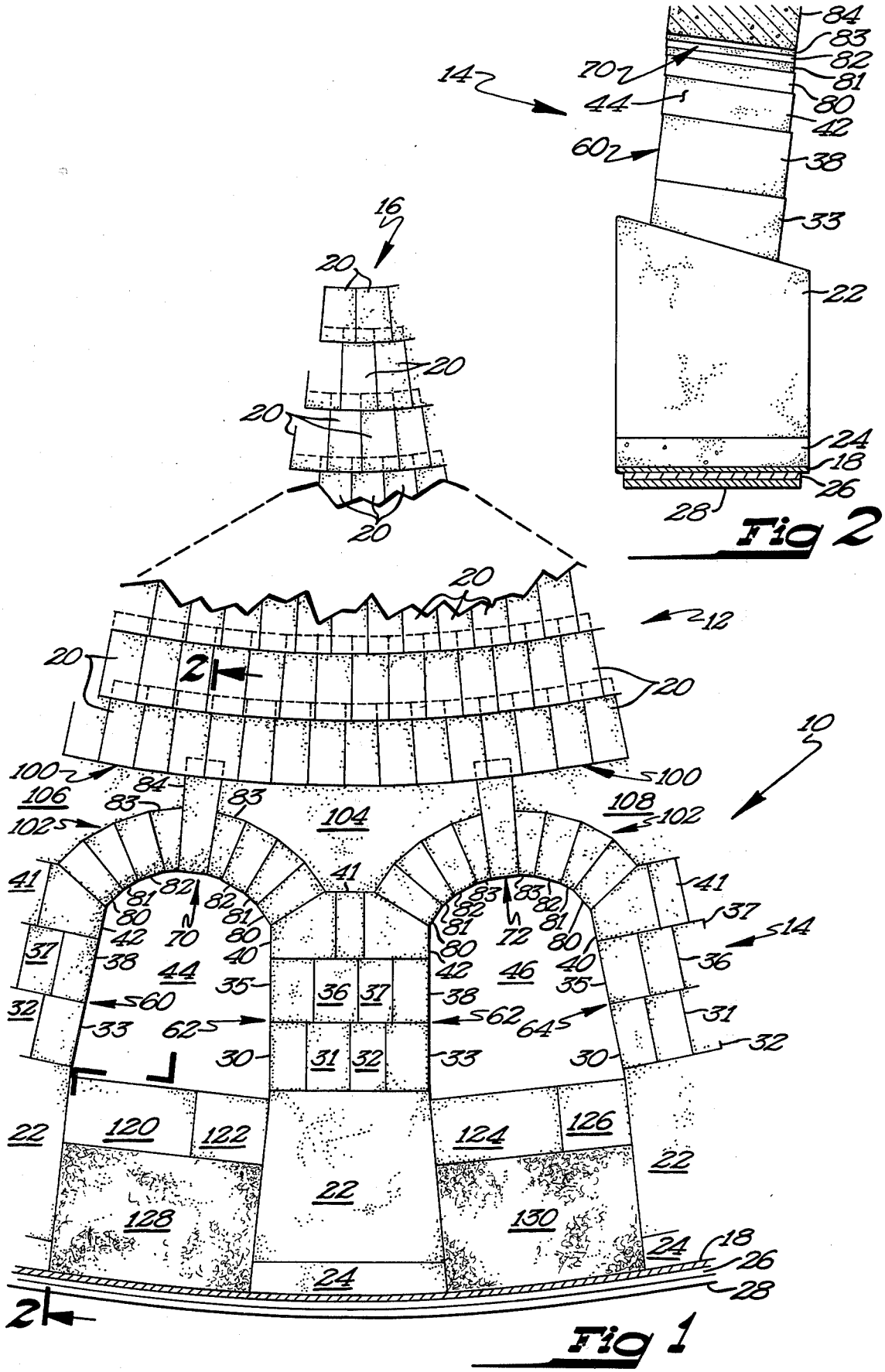
FIG. 1 shows a partial top plan view of a hearth structure according to the teachings of the present invention as positioned in an incinerator structure.
FIG. 2 shows a partial cross sectional view of the hearth of FIG. 1 according to the section lines 2—2 of FIG. 1.

All figures are drawn for ease of explanation of the basic teachings of the present invention only. The extensions of the figures with respect to number, position, relationship, and dimensions of the parts to form a preferred embodiment will be explained or will be obvious to those skilled in the art from the explanation given.

Further, the exact dimensions and dimensional proportions to conform to specific incinerators and geometrics will likewise be with in the skill of the art after the following teachings of the present invention have been read and understood.

Where used in the various figures of the drawings, the same numerals designate the same or similar parts in a hearths. Furthermore, when the terms "right", "left", "front", "back", "vertical", "horizontal", "righthand", "lefthand", "in", "out" and similar terms are used herein, it should be understood that these terms have reference only to the structure shown in the drawings as it would appear to a person viewing the drawings and are utilized only to facilitate describing the invention. No limitation is intended or should be attached.

DESCRIPTION

The hearth structure of the present invention has application in various types of incinerators, and most particularly in the type of incinerator shown in the Connolly patent, U.S. Pat. No. 2,221,076 as set out above. The disclosure of the Connolly patent should then be referred to if no familarity is had with the particular, and now quite conventional, incinerator type with which the present invention has relation. The disclosure of a Connolly patent is then hereby incorporated by reference to the extent necessary. No limitation to the Herreshoff type of multiple hearth furnace as described in the Connolly patent is intended or should be attributed, however. The present invention may be used in many hearths, such as those hearths described in U.S. Pat. Nos. 1,322,223; 2,104,526; 2,225,199; and others.

With this brief preamble, a description of the present invention will be directed to those skilled in the art who are assumed to be well aware of the workings and construction of the incinerators set out above and like incinerators, and the description will be pointedly directed towards the improvement provided by the present invention.

In the figures, a portion of a typical "out" hearth is generally designated 10 and shown according to the present invention. Out hearth 10 is then shown for an incinerator of an outer diameter of approximately 22 feet, but can be readily adapted to most of the used incinerator diameters between 15 feet and 30 feet and certainly others. The out hearth of the present invention can also be arranged to accommodate approximately 90% of the incinerators in use, with little or no effort, and accommodate the remainder with additional modifications. Hearth 10 then includes a main body, generally designated 12, and a drop hole area, generally designated 14. Main body 12, as is well known to those skilled in the art, extends from a central portion or core of the incinerator or from the center of the incinerator, as generally designated 16, and outwardly towards the outside wall 18. Main body 12 is then formed of now conventional standard size fire brick in concentric rings to form a part of the out hearth 10.

Main body 12 is then formed from a plurality of standard size and shape fire brick 20, rather than the special shapes shown in U.S. Pat. No. 2,221,076. This progress in the art from the special shapes of U.S. Pat. No. 2,221,076 to the standard size and shape fire brick or refractory block is then the desired direction of the art; however, until the present invention and for many, many years, drop hole areas 14 were yet exclusively made through use of the special shapes as in U.S. Pat. No. 2,221,076, in spite of the need and cost and better results and desire of the trade and the users at least as expressed in reforming part of U.S. Pat. No. 2,221,076 into standard shapes.

The present invention then solves the riddle of fabricating drop hole area 14 with standard sized and shaped fire brick as follows: working in from the wall 18 and towards the center portion or area 16 of the incinerator, standard skew-back or skew block 22, as designated in U.S. Pat. No. 2,221,076, are placed and spaced from wall 18. That is, a castable material 24 is placed between the radially outside end of skew-back blocks 22 and wall 18. As is conventional, wall 18 may be braced with brands 26 and 28.

Standard size and shape fire brick or refractory block are then conventionally supported by skew-back blocks 22. In particular, standard straight fire brick 30, 31, 32, and 33 are supported by skew-back 22, as best shown in section in FIG. 2. More particularly, bricks 30–33 are arranged to be supported by skew-back 22, as by standard on-site brick cuts made in straight fire brick 30–33. Thus, skew-back 22 conventionally supports the weight of hearth 10 through straight brick 30–33. Skew-back blocks 22 then form weight supporting projections extending from the outer wall 18 of the incinerator.

A second layer of standard straight fire brick or refractory block 35, 36, 37, and 38 are then laid adjacent first layer 30–33 in a standard masons fashion with an upward and outward inclination of approximately one and three quarters inches per inward foot, and with a total hearth 10 rise of approximately one inch per foot, as is conventional.

A third layer is then laid with the third layer including additional standard refractory brick or fire block formed of oppositely directed skew-back members 40 and 42 and a standard refractory brick or fire block straight portion 41 therebetween.

First layer, second layer, and third layer then form a side projection of standard size fire brick, fire block, refractory brick, or refractory block, all of which are intended to be equivalent terms, extending inwardly from and supported by weight supporting projections, in the form of skew-backs 22. The extent of the inward dimension of the side projections is determined by the desired size drop holes 44, 46, and others around the entire circumference of the incinerator. In particular, side projections designated 60 and 62 determine the size of drop hole 44, and side projections 62 and 64 determine the size of drop hole 46, and so on around the circumference. These side projections then set the desired size of the drop holes and form the sides of these drop holes.

Next, a generally horizontal arch of standard size fire brick is sprung between the oppositely directed skew-backs 40 and 42. And particularly, arch 70 is sprung between skew-back 42 of side projections 60 and skew-back 40 of side projection 62. Similarly, arch 72 is sprung between skew-back 42 of side projection 62 and skew-back 40 of side projection 64. Similar arches are then sprung around the circumference of the incinerator. The arches enclose the drop holes between the two side projections.

The arches then include standard size fire brick and, in the preferred embodiment shown include: standard size arch brick 80 adjacent skew-backs 40 and 42; standard size arch brick 81 next; standard size arch brick 82 next; standard size arch brick 83 next; and standard size arch brick 84 as the key of the arch. Arches 70, 72, and the rest of the arches around the circumference of the incinerator then include arch brick 80, 81, 82, 83, key 84, and arch brick 83, 82, 81, and 80.

Arch key 84 is arranged with a dimension longer than that of the adjacent arch brick 80–83 to thereby space the radially outer-most end 100 of main body 12 from the inner-most curve 102 of the remaining arch brick 80–83. Space 104 formed between end 100 of main body 12 and curve 102 of arch 70 and curve 102 of arch 72 is then filled with suitable refractory material which is moldable and fire brick quality. The remaining spaces 106, 108, and the others around the circumference of the incinerator are similary filled.

Additional fire brick 120, 122, 124, 126, and the remainder around the circumference of the incinerator then conventionally form filler material for the incinerator and usually are formed of straight fire brick. Insulation 128, 130, and the remainder around the circumference of the incinerator then conventionally spaces fire brick 120, 122, 124, 126 and the rest from outer wall 18.

Thus, it can now be seen that the entire hearth 10 according to the present invention may be constructed and fabricated entirely from standard size fire brick and eliminate the necessity of special shapes of fire brick in drop hole area 14.

A further subtlety of the present invention may now be explained. Hearth 10 according to the present invention can be utilized to repair and replace approximately 90% of the existing out drop hearths utilizing special shapes of fire brick at a greatly reduced cost. Thus, due to the design of incinerators and of the extreme heat experienced by the hearths and especially due to the drop hole openings, incinerator hearths are susceptible to breaking loose and heaving up from the perimeter wall and falling down against the next lower hearth thus causing unscheduled shut down of the incinerator. This possibility of catastrophic damage thus necessitates repairing any affected areas before a hearth falls completely and damages the next hearth. The present invention can effect such repairs on approximately 90% of the existing out drop hearth structures, and at this greatly reduced cost.

Now that the basic construction and fabrication of the hearth 10 according to the present invention has been explained, the selection of various perameters for the hearth 10 specifically shown in the figures can be explained. Perferred values for the components of hearth 10 according to the present invention will now be set out. It will be realized to those skilled in the art that no limitation to these values is intended, and the values are given as a guide and aid to persons lawfully using and utilizing the present invention.

First, the hearth 10 is shown for an incinerator of approximately 22 foot outside diameter.

Next, all fire brick in the hearth 10 of the present invention are of standard size and shape and readily available. These sizes are:

a. fire brick 20 is of well known standard combinations.

b. fire brick 30 and 32 are standard straight fire brick of a size 9 by 4½ by 2½ inches.

c. fire brick 31 and 33 are standard straight fire brick of a size 9 by 4½ by 3 inches.

d. fire brick 35 and 36 are standard straight fire brick of a size 9 by 4½ by 3 inches.

e. fire brick 37 and 38 are standard straight fire brick of a size 9 by 4½ by 2 inches.

f. fire brick 40 and 42 are standard skew-back block of a 53 degree or 60 degree angle and of a size of 9 by 4½ by 4½ inches.

g. fire brick 41 is a standard straight fire brick of a size 9½ by 4½ by 2 inches.

h. skew-back 22 is generally in the existing incinerator, and varies from incinerator to incinerator, and may be replaced by standard straight fire brick.

i. arch brick 80 is a standard No. 2 arch of dimension 9 by 4½ by 2½ inches.

j. arch brick 81 and 83 are standard No. 3 arch of dimension 9 by 4½ by 2½ inches.

k. arch brick 82 is a standard No. 1 or No. 2 or No. 3 arch of dimension 9 by 4½ by 2½ inches.

l. arch brick 84 is a standard No. 1 or No. 2 arch of dimension 9 by 6¾ by 2½ inches.

Thus, the basic requirements of the present invention have been set out, and extension to various other diameters will now be obvious to those skilled in the art. For example, normally the area and number of drop holes is defined first. Once the area and number of drop holes is set, and with the particular incinerator diameter in mind, the inward extent and all dimensions of the side projections, such as 60, 62, and 64, may be determined to yield the area and number of drop holes desired. That is, fire brick of standard size is selected to conform to the dimensions of the side projections. The number of layers is then dependent on the choice of brick and the drop hole dimensions. The effect of possibly preexisting skew-back blocks, such as 22 in the case of an incinerator to be repaired or rebuilt, must also be considered. Closure of the side projections must then be accomplished, and this closure member in the preferred embodiment is an arch. In the preferred embodiment, the side projections then terminate in an arch and skew-back block should be used on the last layer of the side projections to allow the arch to be sprung between adjacent skew-backs. The size of the arch brick is then also determined by the size of the arch required. Therefore, it can now be appreciated that the present invention can easily be accommodated to both larger and smaller diameters than the diameter for which the preferred embodiment is described.

Now that the basic teachings of the present invention have been explained, many extensions and variations will be obvious to one having ordinary skill in the art, some of which have been explained. Thus, since the invention disclosed herein may be embodied in other specific forms without departing from the spirit or general characteristics thereof, some of which forms have been indicated, the embodiments described herein are to be considered in all respects illustrative and not restrictive. The scope of the present invention is indicated by the appended claims, rather than by the foregoing description, and all changes which come within the meaning and range of equivalency of the claims are intended to be embraced therein.

What is claimed is:

1. In an incinerator structure of circular cross section and including multiple hearths at differing vertical levels, with each alternate hearth being an out-hearth extending from an outer wall of the incinerator towards the center of the incinerator and having a plurality of regularly spaced drop holes formed in the outhearth adjacent the outer wall of the incinerator, and with the out-hearth having a main body of fire brick extending from the center of the incinerator and joining the drop hole area of the out-hearth adjacent the outer wall of the hearth, the improvement in the drop hole area of the hearth, comprising: skew-back blocks projecting from the outer wall of the incinerator; projections of standard size straight fire brick extending out from and supported by the skew-back block to allow for the desired size of drop hole and forming the sides of the drop hole; additionally skew-back block terminating the projections and oppositely directed; generally horizontal arch of standard size arch fire brick sprung between the skew-back blocks of adjacent projections to close the drop hole between adjacent projections, with the arch having key means of a dimension longer than the adjacent arch brick and arranged to support the main body of the hearth and space the radially outer most end of the main body of the hearth from the curve of the remaining brick of the arch; a filler of suitable moldable refractory material of fire brick quality closing the spacing between the radially outer-most end of the main body of the hearth and the curve of each arch, wherein the entire out-hearth may be constructed from standard size fire brick to eliminate the necessity of special shapes of fire brick in the entire hearth.

2. In a incinerator structure including at least one hearth extending from an outer wall towards the center of the incinerator and having at least one drop hole formed in the hearth adjacent the outer wall, with the hearth having a main body of fire brick extending from the center of the incinerator and joining the drop hole area of the hearth, the improvement in the drop hole area of the hearth, comprising: weight supporting projection means extending from the outer wall; at least two side projections of standard size fire brick extending out from and supported by the weight supporting projection means to allow for the desired size of drop hole and forming the sides of the drop hole; generally horizontal closure member of standard size fire brick between the side projections to close the drop hole between the two side projections, with part of the closure member arranged to support the main body of the hearth, wherein the entire hearth may be constructed from standard size fire brick and eliminate the necessity of special shapes of fire brick.

3. The hearth of claim 2, wherein the closure member comprises an arch having fire brick arranged to support the main body of the hearth.

4. The hearth of claim 3, wherein the arch has a key and wherein the main body supporting brick comprises arch brick positioned at the key of the arch.

5. The hearth of claim 4, wherein the arch brick at the key of the arch is of a dimension longer than the adjacent arch brick to thereby form a space between the end of the main body of the hearth and the curve of the remaining arch brick.

6. The hearth of claim 5, wherein filler of suitable refractory material is utilized to close the space between the end of the main body of the hearth and the curve of the arch brick adjacent the drop hole area.

7. The hearth of claim 6, wherein the filler material comprises moldable material of fire brick quality.

8. The hearth of claim 3, wherein the side projections comprise straight brick terminating in skew-back blocks to receive the arch.

9. The hearth of claim 2, wherein: the side projections comprise straight brick terminating in skew-back brick to receive the arch; wherein the weight supporting projections comprise skew-back brick; and wherein the main body supporting brick comprises arch brick at the key of the arch, with the arch brick at the key of the arch of a dimension longer than the adjacent arch brick to therefore space the end of the main body of the hearth from the curve of the remaining arch brick and with filler of suitable moldable, refractory, fire brick quality, material closing the space between the curve of the arch exterior of the drop hole and the end of the main body of the hearth.

10. The hearth of claim 2, wherein the weight supporting projections comprise skew-backs.

* * * * *